US008579184B2

(12) United States Patent
Pettersson et al.

(10) Patent No.: US 8,579,184 B2
(45) Date of Patent: Nov. 12, 2013

(54) COLLAPSIBLE CARDBOARD BOX

(75) Inventors: Claes Pettersson, Mariestad (SE); Kristian Grennfelt, Mölndal (SE); Jan Kolehmainen, Torslanda (SE); Lennart Wernersson, Värnamo (SE); Marcus Hansson, Göteborg (SE); Mateus Cander, Lilla Edet (SE); Patrik Thonfors, Göteborg (SE); Peter Andersson, Mariestad (SE); Susanne Gungner, Älvängen (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 13/503,177

(22) PCT Filed: Oct. 22, 2009

(86) PCT No.: PCT/SE2009/051203

§ 371 (c)(1),
(2), (4) Date: Jun. 11, 2012

(87) PCT Pub. No.: WO2011/049493

PCT Pub. Date: Apr. 28, 2011

(65) Prior Publication Data

US 2012/0241509 A1 Sep. 27, 2012

(51) Int. Cl.
*B65D 5/468* (2006.01)

(52) U.S. Cl.
USPC ..... 229/117.14; 229/117.13

(58) Field of Classification Search
USPC ..... 229/117.12, 117.13, 117.14, 117.16, 229/120
See application file for complete search history.

(56) References Cited

U.S. PATENT DOCUMENTS

| | | | | |
|---|---|---|---|---|
| 1,532,316 | A | 4/1925 | Kaufman | |
| 1,668,800 | A * | 5/1928 | Bonfield | 229/117.14 |
| 1,965,503 | A * | 7/1934 | Lowman | 229/117.13 |
| 2,900,124 | A * | 8/1959 | Leone | 229/117.14 |
| 4,010,888 | A * | 3/1977 | Gilbert | 229/117.14 |
| 4,406,380 | A | 9/1983 | Paige | |
| 5,325,602 | A * | 7/1994 | Nainis et al. | 229/120 |
| 5,779,049 | A * | 7/1998 | Werby et al. | 229/117.13 |
| 6,302,320 | B1 * | 10/2001 | Stout | 229/117.13 |
| 2004/0031842 | A1 | 2/2004 | Westerman et al. | |
| 2008/0172940 | A1 * | 7/2008 | Huang et al. | 229/120 |

FOREIGN PATENT DOCUMENTS

| | | |
|---|---|---|
| FR | 2 116 269 | 7/1972 |
| FR | 2 742 731 | 6/1997 |
| GB | 231697 | 4/1925 |

(Continued)

*Primary Examiner* — Gary Elkins
(74) *Attorney, Agent, or Firm* — Drinker Biddle & Reath LLP

(57) ABSTRACT

A collapsible cardboard box including, in an erected state, a back wall, an opposing front wall, a first side wall and an opposing second side wall. In its collapsed state, the box includes a first through hole in the front portion and a second through hole in the back portion. In the collapsed state, the box has been unfolded in such a way that the first and second through holes are in line with each other forming a handle for allowing a person to carry the collapsed box by use of the first and second through holes.

20 Claims, 11 Drawing Sheets

(56) References Cited

FOREIGN PATENT DOCUMENTS

| | | |
|---|---|---|
| GB | 559084 | 2/1944 |
| GB | 2 377 921 | 1/2003 |
| JP | 50-19847 | 3/1975 |
| JP | 50-123643 | 10/1975 |
| JP | 54-21034 | 2/1979 |
| JP | 57-159616 | 10/1982 |

* cited by examiner

COLLAPSIBLE CARDBOARD BOX

CROSS-REFERENCE TO PRIOR APPLICATION

This application is a §371 National Stage Application of PCT International Application No. PCT/SE2009/051203 filed Oct. 22, 2009, which is incorporated herein in its entirety.

TECHNICAL FIELD

The disclosure refers to a collapsible cardboard box including, in an erected state, a back wall, an opposing front wall, a first side wall and an opposing second side wall, the box also including a bottom side being made from folding together a front portion being attached to the front wall, a back portion attached to the back wall, a first side portion being attached to the first side wall and a second side portion being attached to the second side wall.

BACKGROUND

It is long known to use corrugated collapsible containers in the form of cardboard boxes formed from a blank. The box has in its erected state at least five sides and in its collapsed state the box can either be unfolded and then folded over itself, i.e. double folded, or may be unfolded to return to the blank state. When the box is in its collapsed state a double folded device is advantageous since it takes up less space than the blank state. Hence, the disclosure refers in general to boxes that are collapsed into a double folded device, i.e. into a double folded state.

There are known many different ways to knock-down a box from the erected state to the collapsed state. For example, GB 559084 teaches to knock-down the box into a double folded state by folding two opposing side walls over a centrally placed fold line and GB231697 teaches to knock-down a box by folding a rectangular cuboid shaped box over two diagonally opposed fold lines positioned in line with the corners of the box. The rectangular box then makes its transition to collapsed state over a parallelogram shape so that, in its collapsed state, the double folded box comprises a front wall and a first side wall opposite a back wall and a second side wall.

SUMMARY

Even though the collapsible, knock-down, box has been known for many years a problem still remains. Namely, boxes collapsed into a double folded device/state are hard to carry due to their square or rectangular shape, especially if the double folded device is large and/or if many double folded devices are to be carried at the same time.

In this disclosure, a number of descriptive words have been used for facilitating the description of the invention, for example front, back, side, top and bottom. It should be noted that these words have no limiting effect as such and do not refer to an actual front, back or side, but are interchangeable and/or replaceable with another word. However, if you have, for example, a five sided box it is normal to name that part supposed to be facing the ground the bottom.

This problem can be solved with a collapsible cardboard box including, in an erected state, a back wall, an opposing front wall, a first side wall and an opposing second side wall. The box includes also a bottom side being made from folding together a front portion being attached to the front wall, a back portion being attached to the back wall, a first side portion being attached to the first side wall and a second side portion being attached to the second side wall. In a collapsed state, the box includes a first through hole at least partly positioned in the front portion and a second through hole at least partly positioned in the back portion. The bottom side has been unfolded and the other parts of the box have been folded in such a way that the first and second through holes are in line with each other forming a handle for allowing a person to carry the collapsed box by use of the first and second through holes.

One advantage of embodiments of the invention is that this standard type of cardboard box can be folded and then be carried by use of the handle instead as before having to grip about the side edges of the collapsed box.

Here, attachment could mean that a portion, for example the front portion, and a wall, for example the front wall, are made from one piece, e.g. a blank, but divided into the different parts by a folding line. Attachment could also mean that a portion, for example the front portion, and a wall, for example the front wall, are two pieces being forged to each other by any means known in the art, for example gluing, welding, mechanical pressure, and/or stitching. The forged portion will then have a use as a fold line when erecting or collapsing the box.

The box could be formed from a blank including the front wall, the back wall, the first and second side walls, the front portion, the back portion and the first and second side portions.

The advantage of using a blank is that it is easy to manufacture the box.

It is advantageous if, in the collapsed state, the front portion and the back portion, at least partly, are in contact with each other, since this allows for the user to secure the collapsed box in its folded position by grabbing/gripping the handle.

The method of knocking down the box can vary dependent on how the first and second through holes are positioned in the front portion and the back portion respectively. The bottom side shall be unfolded and then the box shall be folded about fold lines existing in the corner lines of the box into a double folded box via a parallelogram shape so that the front wall faces at least a part of the first side wall; or should be folded over symmetrical fold lines positioned in the first and second side walls and first and second side portions such that the front wall faces only the back wall. These methods are simple and robust.

Here, "corner lines" means that part of the box existing in the transition area between the front wall, back wall, first side wall and second side wall.

These methods also normally mean that, in both the collapsed state and the erected state, the front wall, the first side wall, the back wall and the second side wall are attached to each other.

Two examples will now be presented for creating the first and second through holes.

In the first example; the front portion includes the first through hole and the back portion includes the second through hole, when the box is both in the erected state and in the collapsed state. Hence, the holes are pre-made.

In the second example; when the box is in the erected state, the front portion includes a first area with weak perimeter, which first area is attached to an underlying part of the box in such a way that when unfolding the front portion the weak perimeter breaks and the first area stays attached to the underlying part wherein the first through hole is created, and wherein the back portion includes a second area with weak perimeter, which second area is attached to an underlying part of the box in such a way that when unfolding the back portion the weak perimeter breaks and the second area stays attached to the underlying part wherein the second through hole is created. The first and second through holes are thus created when the box is collapsed for the first time. This also means that the first and second area must be permanently attached to an underlying or overlying portion of the box that allows for the weak perimeter to break and for the first and second area to stay attached. The erection of the box could be made in a manufacturing plant or the erection could be made by a user that erects the box upon use. The first and second areas could therefore be equipped with attachment means with or without a protective layer that could be removed before the erection for attaching the first and second area to the underlying or overlying portion. However, the attachment means could also be applied upon erection for attachment of the first and second area. Furthermore, the entire front portion and back portion could be attached to the first and second side portions to secure the box in the erected state. When collapsing the box, the bottom side is unfolded by breaking the bond between the front portion and the first and second side portions; and breaking the bond between the back portion and the first and second side portions. Since the first and second areas have weak perimeters being weaker than the bond, the areas stay attached to the first and second side portions respectively instead of breaking the bond.

In the collapsed state, the first through hole and the second through hole are advantageously positioned to allow a person to balance the collapsed box approximately about the centre of gravity of the collapsed box. This has the advantage that the collapsed box becomes easier to carry.

BRIEF DESCRIPTION OF DRAWINGS

Embodiments of the invention will below be described in connection to a number of drawings, in which:

FIG. 10 schematically shows a sixth example of a box according to the invention having a quadratic cross-section, and in which:

DESCRIPTION OF PREFERRED EMBODIMENTS

Figure 1:
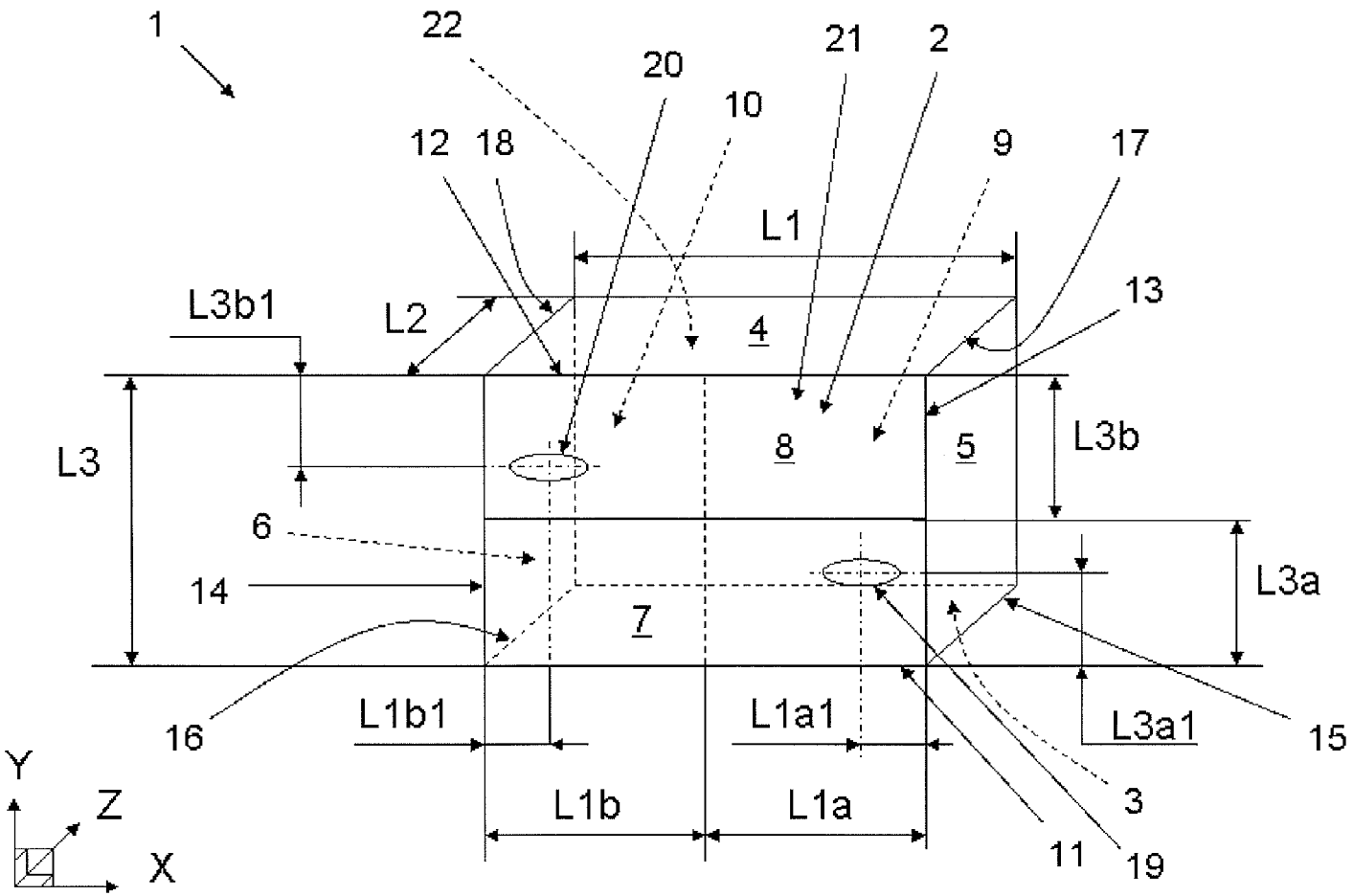
FIG. 1 schematically shows a perspective view of an erected five sided cardboard box according to a first example of the invention with a bottom side of the box facing the reader.

FIG. 1 schematically shows a perspective view of an erected five sided cardboard box 1 according to a first example of the invention with a bottom side 2 of the box facing the reader. The collapsible cardboard box 1 comprises, in the erected state, a front wall 3, an opposing back wall 4, a first side wall 5 and an opposing second side wall 6. The front wall 3, the back wall 4, the first side wall 5 and the second side wall 6 are attached to each other forming a box with a cube or rectangular cuboid shape. In FIG. 1, the front wall 3 and the back wall 4 are essentially of the same width L1 and height L2. The first side wall 5 and the second side wall 6 are essentially of the same width L3 and height L2. The height L2 of the front wall 3, the back wall 4, the first side wall 5 and the second side wall 6 is essentially equal. If the front wall width and back wall width L1 is equal to the first and second side wall width L3 and equal to the height L2, the box is cubic shaped but if any one of L1, L2 or L3 is different from the other the box 1 is in the shape of a rectangular cuboid.

In FIG. 1, the box 1 also comprises a bottom side 2 being made from folding together a front portion 7 being attached to the front wall 3, a back portion 8 attached to the back wall 4, a first side portion 9 being attached to the first side wall 5 and a second side portion 10 being attached to the second side wall 6.

Here attachment could mean that a portion 7-10, for example the front portion 7, and a wall 3-6, for example the front wall 3, are made from one piece, e.g. a blank, but divided into the different parts by a folding line. Attachment could also mean that the a portion 7-10, for example the front portion, and a wall 3-6, for example the front wall 3, are two pieces being forged to each other by any means known in the art, for example gluing, welding, mechanical pressure, and/or stitching. The forged portion will then have a use as a fold line when erecting or collapsing the box.

In FIG. 1, the front portion 7 and the front wall 3 is made from one piece comprising a predetermined first fold line 11 dividing the front portion 7 and the front wall 3. The back portion 8 and the back wall 4 are made from one piece comprising a predetermined second fold line 12 dividing the back portion 8 and the back wall 4. The first side portion 9 and the first side wall 5 are made from one piece comprising a predetermined third fold line 13 dividing the first side portion 9 and the first side wall 5. The second side portion 10 and the second side wall 6 are made from one piece comprising a predetermined fourth fold line 14 dividing the second side portion 10 and the second side wall 6.

The box has a first corner fold line 15 between the front wall 3 and the first side wall 5, a second corner fold line 16 between the front wall and the second side wall, a third corner fold wall 17 between the back wall 4 and the first side wall 5, and a fourth corner fold line 18 between the back wall 4 and the second side wall 6. The first, second, third and fourth corner fold lines, 15-18 are used both when the box 1 is erected and collapsed.

The above mentioned fold lines 11-18 are predetermined zones that serve as guides for folding and unfolding the box. The fold lines 11-18 can be made in any way known in the art, for example creased, weakened, reinforced, or slit.

The box in FIG. 1 is collapsed by unfolding the bottom side 2 and then collapsed over the first, second, third and fourth corner fold lines 15-18. A cubic or rectangular cuboid shaped box 1 then makes its transition to a collapsed state over a parallelogram shape so that, in its collapsed state, the double folded box 1 comprises the front wall 3 and the first side wall 5 opposite the back wall 4 and the second side wall 6.

The box 1 could be formed from a blank comprising the front wall 3, the back wall 4, the first and second side walls 5, 6, the front portion 7, the back portion 8 and the first and second side portions 9, 10. An example of such a blank is described in connection to FIGS. 8 and 9.

In FIG. 1, the front portion 7 comprises a first through hole 19 and the back portion 8 comprises a second through hole 20. The first and second through holes 19, 20 are positioned such that when the box 1 is collapsed the first and second through holes are in line and form a grip. The advantage of the grip is that a user easily can carry one or more collapsed boxes. This will be described further below and in connection to FIGS. 2-8.

The first and second through holes 19, 20 can be pre-made, i.e. can be a permanent feature in both the erected state and the collapsed state. The first and second through holes can also be created when the box 1 is collapsed for the first time, i.e. when unfolding the bottom side 2, by allowing parts/areas to be separated from the front portion 7 and back portion 8 respectively thereby creating the first and second through holes. The latter example will be explained also in detail in connection to FIGS. 8 and 9.

The method for folding the front portion 7, the back portion 8, the first side portion 9 and the second side portion 10 into the bottom side 2 is dependent on whether the first and second through holes 19, 20 are pre-made or if they should be created when unfolding the bottom side 2. If the first and second through holes 19, 20 are pre-made it is not necessary on account of the first and second through holes 19, 20 how the bottom side 2 is created since the first and second through holes 19, 20 are already present in the correct position. However account should be taken to the size of the front portion 7, back portion 8, first side portion 9 and second side portion 10 regarding whether if the first through hole 19 and/or the second through hole 20 could be accepted as a through hole in the erected box or if the first and/or second through hole 20 should be covered with a part of any of the front portion 7, back portion 8, first side portion 9 and/or the second side portion 10.

If the first and second through holes 19, 20 are to be created when unfolding the bottom side 2, the first and second side portion 9, 10 advantageously are folded before the front portion 7 and back portion 8 since the parts/areas that are to be separated from the front portion 7 and back portion 8, respectively, have to be permanently attached to an underlying material, advantageously the first side portion 9 and the second side portion, respectively. The advantage lies in the simplicity of folding together the bottom side 2 and the simplicity during manufacturing of the box, since essentially there is only needed one rectangular blank with slits forming the front portion 7, the back portion 8 the first side portion 9 and the second side portion 10. This will be explained further in connection to FIGS. 8 and 9.

FIG. 1 shows a box 1 with dimensions and method of folding the front portion 7, the back portion 8, the first side portion 9 and the second side portion 10 into the bottom side 2 that allows for both pre-made first and second through holes 19, 20 and first and second through holes 19, 20 that are to be created when unfolding the bottom side 2.

In FIG. 1, the first side portion 9 and the second side portion 10 is folded before the front portion 7 and the back portion 8. Hence, the front portion 7 partly overlies both the first side portion 9 and the second side portion 10 and the back portion 8 partly overlies both the first side portion 9 and the second side portion 10. The front portion 7 and the back portion 8 form an outer bottom surface 21 onto which the box 1 can rest.

In FIG. 1 the dimensions of the box 1 have the following denotations:

L1 is the width of the box 1 in a longitudinal direction X, i.e. the width of the front wall 3, the back wall 4, the bottom side 2, the front portion 7, the back portion 8 and an opening 22 in a five sided box, or a top side in a six sided box, taken between the first side wall 5 and the second side wall 6.

L2 is the height of the box 1 in a height direction Z, i.e. the height of the front wall 3, the back wall 4, the first side wall 5 and the second side wall 6 taken between the bottom side 2 and, for a five sided box, the opening 22; or, for a six sided box, taken between the bottom side 2 and the top side.

L3 is the width of the box 1 in a lateral direction Y, i.e. the width of the bottom side 2, the first side wall 5, the second side wall 6, the first side portion 9, the second side portion 10 and the opening in a five sided box, or the top side in a six sided box, taken between the front wall 3 and the back wall 4.

L1*a* is the width of the first side portion 9 taken from the first side wall 5.

L1*a*1 is the distance from the first side wall 5 to the centre of the first through hole 19 in the front portion 7. Here centre of the first through hole 19 refers to a geometrical representation of the centre of gravity of the first through hole.

L1*b* is the width of the second side portion 10 taken from the second side wall 6.

L1*b*1 is the distance from the second side wall 6 to the centre of the second through hole 20 in the back portion 8. Here centre of the second through hole refers to a geometrical representation of the centre of gravity of the second through hole 20.

L3*a* is the width of the front portion 7 taken from the front wall 3.

L3*a*1 is the distance from the front wall 3 to the centre of the first through hole 19 in the front portion 7.

L3*b* is the width of the back portion 8 taken from the back wall 4.

L3*b*1 is the distance from the back wall 4 to the centre of the second through hole 20 in the back portion 8.

As mentioned above, FIG. 1 shows that the first and second side portions 9, 10 have been folded before the front portion 7 and the back portion 8. In FIG. 1, L1*a* is essentially equal to L1*b* which is essentially equal to L1 divided by two; and L3*a* is essentially equal to L3*b* which is essentially equal to L3 divided by two. This gives that the first and second side portions 9, 10 do not overlap each other and that the front portion 7 and back portion 8 do not overlap each other. This has the advantage that the outer bottom surface 21 becomes planar and also has the advantage of a simple manufacturing method since a rectangular blank can be used for erecting the box 1. It should be noted that L1*a* could be equal to, larger than or less than L1*b*, with L1*a*+L1*b*≤L1, with the bottom surface 21 still being planar since the first and second side portions 9, 10 do not overlap each.

As mentioned above, the bottom side 2 can be created by various methods of folding the front portion 7, back portion 8, first side portion 9 and second side portion 10 into the bottom side. Said portions 7-10 may have various shapes and sizes, but if the first and second through holes 19, 20 are to be created when unfolding said portions 7-10, below are two examples giving information on how the parts/areas can be permanently attached to the first side portion 9 and second side portion 10, respectively:

EXAMPLE 1

$$L1a \geq L1a1$$

and $$L1b \geq L1b1$$

which means that the first side portion 9 has an extension L1*a* from the first side wall 5 that exceeds the distance L1*a*1 from the first side wall 5 to the centre of the first through hole 19 in the front portion 7, and that the second side portion 10 has an extension L1*b* from the second side wall 6 that exceeds the distance L1*b*1 from the second side wall 6 to the centre of the second through hole 20 in the back portion 8. In this way the front portion 7 overlaps the first side portion 9 and the back portion 8 overlaps the second side portion 10 such that the parts/areas that are to be removed may be attached to the corresponding underlying portion.

EXAMPLE 2

$$L3a \geq L3 - L3b1$$

and $$L3b \geq L3 - L3a1$$

which means that the front portion 7 has an extension L1*a* from the front wall 3 that exceeds the distance L3−L3*a*1 from the front wall 3 to the centre of the first through hole 19 in the back portion 8, and that the back portion 8 has an extension L3*b* from the back wall 4 that exceeds the distance L3−L3*a*1 taken from the back wall 4 to the centre of the first through hole 19 in the back portion 8. In this way the front portion 7 and the back portion 8 overlaps each other in such a way that the parts/areas that are to be removed may be attached to an underlying and an overlying portion. If only a part of the front portion has an extension L1*a* from the front wall 3 that exceeds the distance L3−L3*a*1 from the front wall 3 to the centre of the first through hole 19 in the back portion 8, and that only a part of the back portion 8 has an extension L3*b* from the back wall 4 that exceeds the distance L3−L3*a*1 taken from the back wall 4 to the centre of the first through hole 19 in the back portion 8, then the front portion 7 and the back portion 8 could overlap each other in such a way that that the two parts/areas that are to be removed may be attached to an underlying portion. For the front portion 7, the underlying portion could be the back portion 8 if the back portion 8 has a slit in the lateral direction. For the back portion 8, the underlying portion could be the front portion 7 if the front portion 7 has a slit in the lateral direction. If the front portion 7 has a stepwise formation the underlying portion could, for the back portion 8, be the first side portion 9 or the second side portion 10. If the back portion 8 has a stepwise formation the underlying portion could, for the front portion 7, be the first side portion 9 or the second side portion 10.

If the pre-made first and second through holes 19, 10 are not to be allowed to be a through hole in the box 1, either the first side portion 9 must have an extension L1*a*, taken from the first side wall 5, such that the first through hole 19 is covered and the second side portion 10 must have an extension L1*b*, taken from the second side wall 6, such that the second through hole 20 is covered; or the first side portion 9 must have an extension L1*a*, taken from the first side wall 5, such that the first through hole 19 and the second through hole are covered; or the second side portion 10 must have an extension L1*b*, taken from the second side wall 6, such that the first through hole 19 and the second through hole 20 are covered; or at least a part of the front portion 7 must have an extension L3*a*, taken from the front wall 3, such that the second through hole 20 is covered and at least a part of the back portion 8 must have an extension L3*b*, taken from the back wall 4, such that the first through hole 19 is covered.

A non-exhaustive list of examples of limitations for the box is as follows:

$$L1a \leq L1$$

$$L1b \leq L1$$

$$L3a \leq L3$$

$$L3b \leq L3$$

$$0 \leq L1a1 \leq L1$$

$$0 \leq L1b1 \leq L1$$

$$0 \leq L3a1 \leq L3a$$

$$0 \leq L3b1 \leq L3b$$

Here it could be deducted that, for example, when you move the oval first through hole 19 as depicted to a position where L1*a*1=0 or L3*a*1=L3*a*, then only half the hole remains and the centre of gravity is no longer the same. However, if the centre of gravity was allowed to change with the diminished size of the hole, there would finally only be an infinitesimal slot left; or worse, if L1*a*1=0 and L3*a*1=L3*a* there would be only a singularity. Therefore, the definition of centre of gravity here refers to the geometrical representation of an imaginary hole being symmetric about an imaginary axis and when L1*a*1=0 or L3*a*1=L3*a* the imaginary axis becomes the zero axis that delimits the hole into half its original shape. When L1*a*1=0 and consequently L1*b*1=0 the other symmetrical half of the first through hole 19 could be positioned in the first side portion 9 and the other symmetrical half of the second through hole 20 could be positioned in the second side portion 10, such that when the box 1 is in the collapsed state the symmetrical halves in the front portion 7 and the first side portion 9 form the first through hole 19 and such that the symmetrical halves in the back portion 8 and the second side portion 10 form the second through hole 20 being in line forming a handle. Hence, when the first and second through holes 19, 20 are larger than L1*a*1 and L1*b*1 respectively a portion of the first through hole 19 could be positioned in the front portion 7 and the remaining portion of the first through hole 20 could be positioned in the first side portion 9 and a portion of the second through hole 20 could be positioned in the back portion 8 and the remaining portion of the second through hole 20 could be positioned in the second side portion 10. Ultimately, L1*a*1=0 and consequently L1*b*1=0 and the first and second through holes 19, 20 are split in halves according to the above. This embodiment will be explained further in connection to FIG. 10.

It should be noted that the labelling of the different parts of the box in connection to FIGS. 1-8 is only to facilitate the description of embodiments of the invention. The front wall could be the back wall and the bottom side could be a top side. The five sided box could also be a six sided box with a top side and a bottom side. What is described in connection to FIGS. 1-8 regarding the through holes in the front and back portions of the bottom side could as well refer to through holes in a front portion and a back portion being part of a top side, or the through holes could in a six sided box be positioned in the front portion and the back portion of both the top side and the bottom side so that the user could chose which grip to use.

Figure 2:
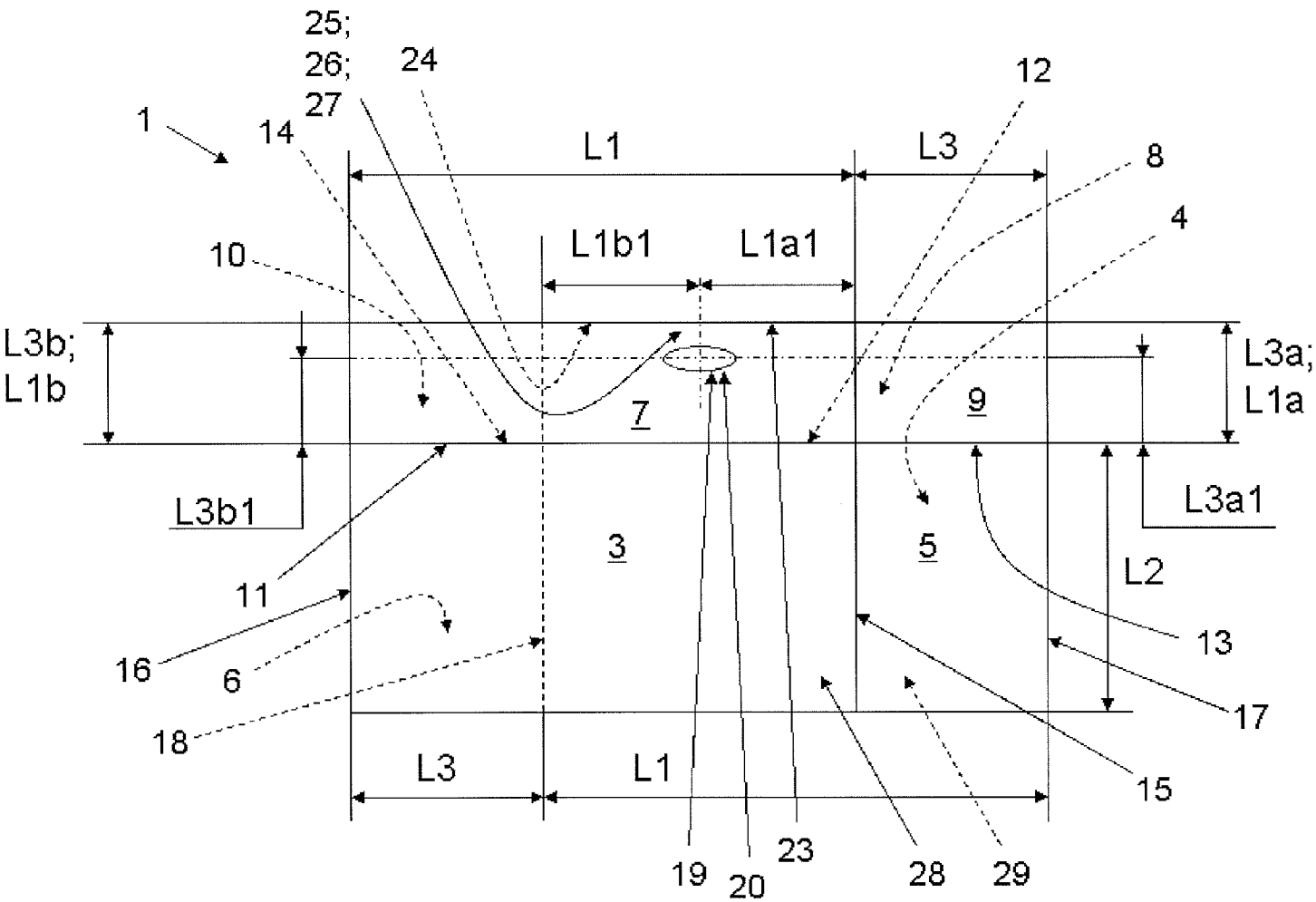
FIG. 2 schematically shows a front view of a collapsed cardboard box according to FIG. 1.

FIG. 2 schematically shows a front view of a collapsed cardboard box 1 according to FIG. 1. FIG. 2 shows that the bottom side 2 has been unfolded and that the other parts of the box 1 has been folded in such a way that at least a part of the front wall 3 and at least a part of the back wall 4 face each other. FIG. 2 shows that the box in its collapsed state comprises the first through hole 19 in the front portion 7 in line with the second through hole 20 in the back portion 8.

The first through hole 19 is positioned at a first distance L3*a*-L3*a*1 from a longitudinally X extending front portion edge 23 and the second through hole 20 is positioned at a second distance L3*b*-L3*b*1 from a longitudinally X extending back portion edge 24. The first distance L3*a*-L3*a*1 defines a first gripping area 25 in the front portion and the second distance L3*a*-L3*a*1 defines a second gripping area 26 in the back portion 8. The first and second gripping areas 25, 26 are essentially in line with each other and form a handle 27 for allowing a person to carry the collapsed box 1 by use of the first and second through holes.

In order for the first and second through holes to be aligned with each other the following has to be true:

L3a−L3a1 is essentially equal to L3b−L3b1 and

L3b1 is essentially equal to L3a1 and

L3a is essentially equal to L3b and

L3a1 is essentially equal to L3b1 and

L1a1 is essentially equal to L1b1 and

L3+L1a1 is essentially equal to L3+L1b1

As been discussed in connection to FIG. 1, the first side portion 9 and the second side portion 10 may have different size than the front portion 7 and the back portion 8 within the limitations described regarding pre-made first and second through holes 19, 20 or first and second through holes 19, 20 being created when unfolding the bottom side.

The symmetry of the box 1 and the alignment of the first and second through holes 19 gives that the opening and thus the handle 27 is positioned for allowing a person to balance the collapsed box approximately about the centre of gravity of the collapsed box 1.

If L1=L3 (not shown) the bottom side is quadratic and the only possible solution for collapsing the box via the corner fold lines 15-18 and getting the first and second through holes 19, 20 in line with the centre of gravity of the collapsed box is if: a first half of the first through hole 19 is positioned in the front portion 7 and if a second half of the first through hole 19 is positioned in the first side portion 9 together forming the first through hole 19 with a centre of gravity in line with the centre of gravity of the collapsed box; and at the same time a first half of the second through hole 20 is positioned in the back portion 8 and if a second half of the second through hole 20 is positioned in the second side portion 10 together forming the second through hole 20 with a centre of gravity in line with the centre of gravity of the collapsed box 1. Another solution to this problem is described in connection to FIGS. 5-7.

The shape of the first and second through holes 19, 20 are advantageously such that a human user could fit the hand into the through holes, i.e. e.g. oval or rectangular shapes are possible, but not limiting for the invention. An elongated hole is therefore advantageous.

The first and second gripping areas 25, 26 should be long and thick enough for allowing a user to grip around at least one handle 27 and advantageously to be able to grip around several handles 27 of different collapsed boxes for simultaneous transport of many collapsed boxes. Since the size of the hand differs from person to person it would be unfair to state exact parameters for the opening and the handle, but a person skilled in the art could find a suitable best fit by use of known statistics on the most "normal" size of a hand.

Furthermore, the first and second through holes could also be used for storing and/or transporting one or more boxes by use of a machine. Such a machine would then comprise protruding means that could be fit into the opening. This mechanical option could have impact on the size of the through holes and the handle in a trade off for best fit between machine and hand.

In FIG. 2, the front wall 3 and the back wall 4, at least partly, are in contact with each other for allowing the user to secure the collapsed box 1 in its folded position by grapping the handle 27.

In FIG. 2, the front wall 3, the front portion 7, the first side wall and the first side portion form a first side unit 28 of the collapsed box 1 and the back wall 4, the back portion 8, the second side wall 6 and the second side portion 10 form a second side unit 29. The first side unit 28 and the second side 29 unit face each other and are, at least partly, in contact with each other for allowing the user to secure the collapsed box 1 in its folded position by grabbing the handle 27.

Figure 3:
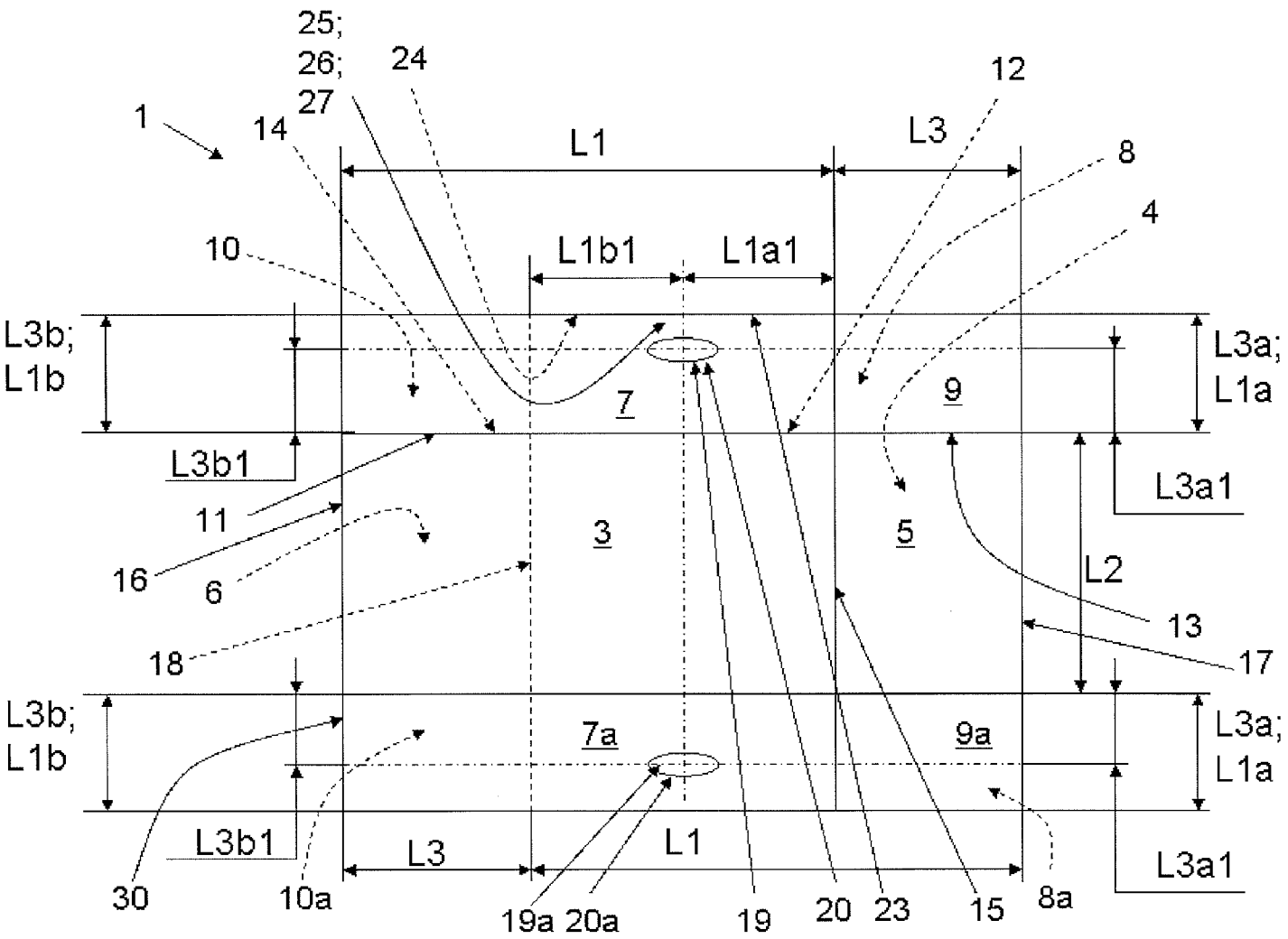
FIG. 3 schematically shows a front view of a collapsed cardboard box according to FIG. 1, but with an additional top side.

FIG. 3 schematically shows a front view of a collapsed cardboard box according to FIG. 1, but with an additional top side 30 to replace/cover the opening in FIG. 1. The top side 30 could be formed from a lid comprising one or many parts. In FIG. 3, the top side has been unfolded but FIG. 3 shows that the top side 30 comprises a top front portion 7*a*, a top back portion 8*a*, a top first side portion 9*a* and a top second side portion 10*a* which could be folded and equipped with a top first through hole 19*a* in the top front portion 7*a* and a top second through hole 20*a* in the top back portion 8*a* in accordance with what has been described in connection to FIGS. 1-2.

Figure 4:
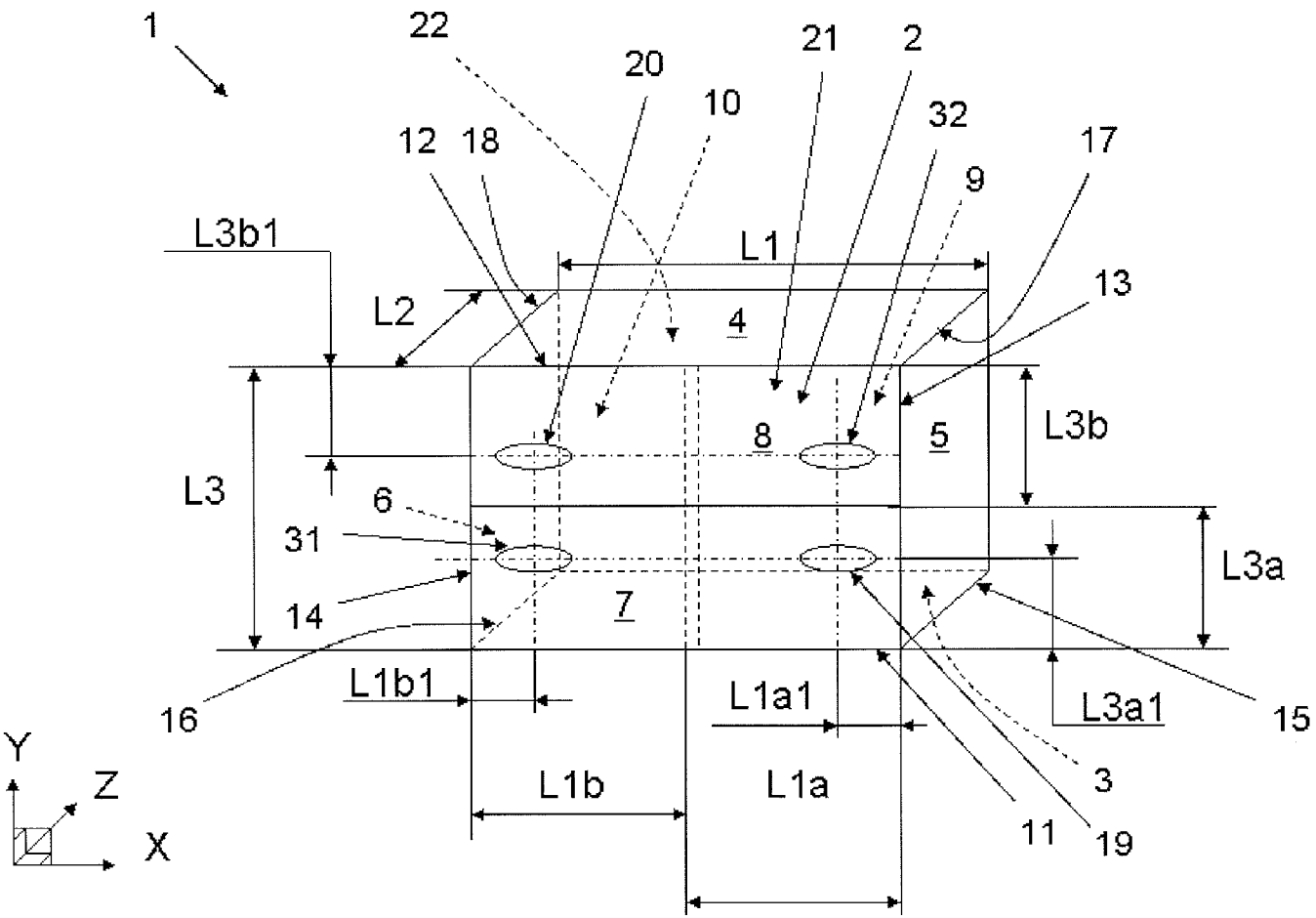
FIG. 4 schematically shows a perspective view of an erected five sided cardboard box according to a second example of the invention with a bottom side of the box facing the reader.

FIG. 4 schematically shows a perspective view of an erected five sided cardboard box 1 according to a second example of the invention with a bottom side 2 of the box 1 facing the reader. The difference between the example in FIG. 4 and the examples described in FIGS. 1-3 is that there are four through holes 19, 20, 31, 32 instead of two. The description of the position of the through holes 19, 20, 31, 32 and the box 1 in connection to FIGS. 1-3 is valid also for FIG. 4. The four through holes 19, 20, 30, 31 gives a user the opportunity to collapse the box 1 such that any pair of diagonally positioned through holes 19, 20, 31, 32 becomes in line with each other to form a handle 27 when the box 1 is collapsed. In FIG. 1 the first through hole 19 should be matched with the second through hole 20 as described in connection to FIGS. 1-3, or a third through hole 31 could be matched to a fourth through hole 32. In FIG. 4, the first through hole 19 is positioned in the front portion 7 over the first side portion 9, the second through hole 20 is positioned in the back portion 8 over the second side portion 10, the third through hole 31 is positioned in the front portion 7 over the second side portion 10, and the fourth through hole 32 is positioned in the back portion 8 over the first side portion 9. In short, the above gives the advantage that a handle is always created no matter how the user collapses the box.

Figure 5:
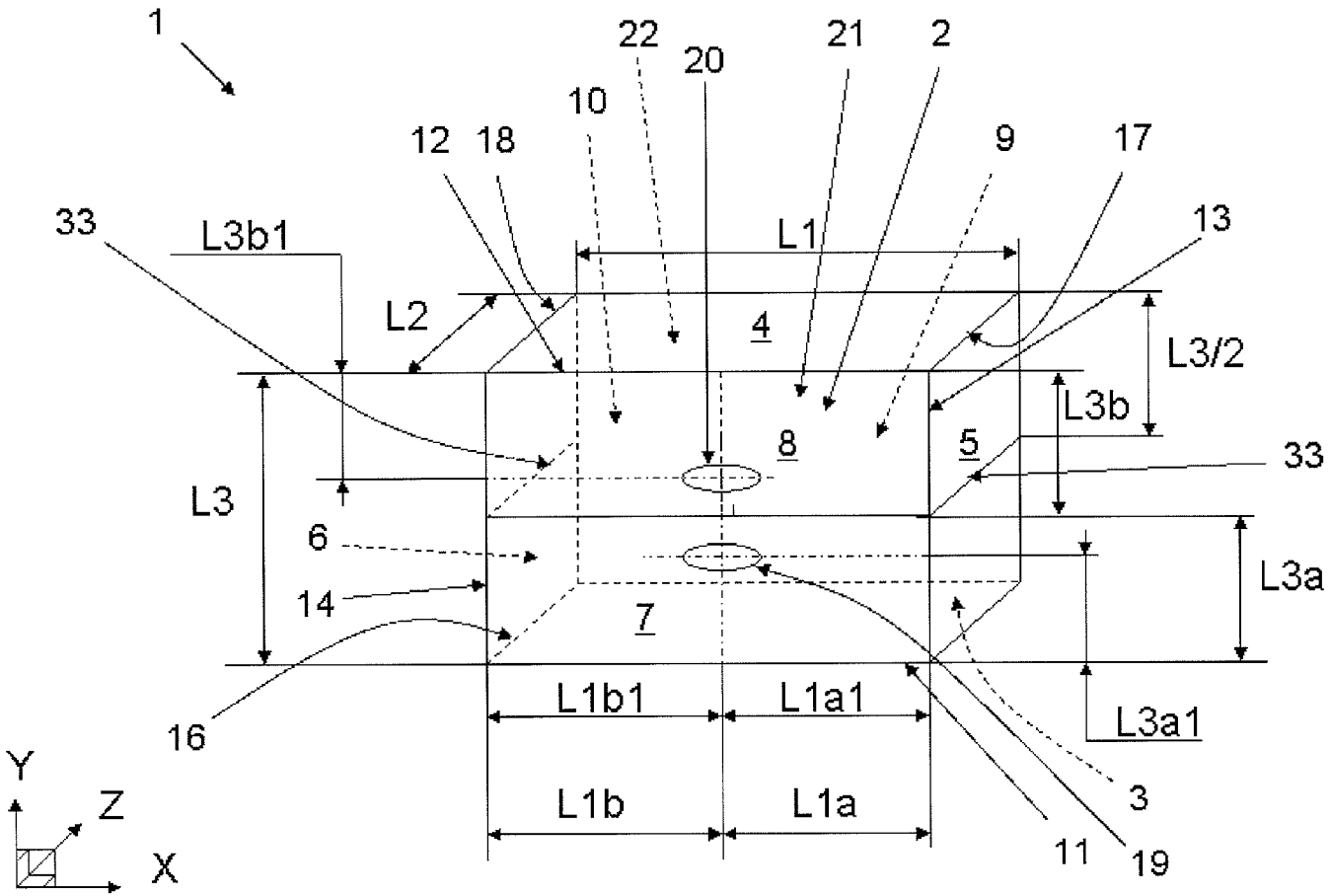
FIG. 5 schematically shows a perspective view of an erected five sided cardboard box according to a third example of the invention with a bottom side of the box facing the reader.

FIG. 5 schematically shows a perspective view of an erected five sided cardboard box according to a third example of the invention with a bottom side of the box facing the reader. The description of the box 1 and position of the first and second through holes 19, are referred to the description in connection of FIGS. 1-4. In FIG. 5, the first through hole 19 is positioned symmetrically with reference to the first side wall 5 and the second side wall 6, i.e. L1*a*=L1*b*=L1*a*1=L1*b*1=L1/2 and the second through hole 20 is positioned symmetrically with reference to the first side wall 5 and the second side wall 6, i.e. L1*a*1=L1*b*1=L1/2. From FIGS. 1-5 and corresponding description, it can be deducted that, for the first through hole 19 to be aligned with the second through hole 20 when the box 1 is in the collapsed state, the first side wall 5 and the second side wall 6 must be folded over a symmetrical fold line 33 extending in the height direction Y, i.e. from the bottom side to the opening of a five sided box 1 or to the top side in a six sided box 1. The symmetrical fold lines 33 are positioned in the first side wall and the second side wall at a distance L3/2 from the front wall 3 and the back wall 4. The nature of the fold line has been discussed in connection to FIGS. 1-4.

It should be noted that this example gives the possibility to have the first and second through holes 19, 20 positioned off the centre of gravity of the collapsed box, since the box is collapsed over the symmetrical fold line 33. This example also allows for simultaneous matching of many holes positioned in the front portion 7, back portion 8, first side portion 9 and second side portion 10 because of the symmetry rules allowed by the symmetrical fold line 33.

Figure 6:
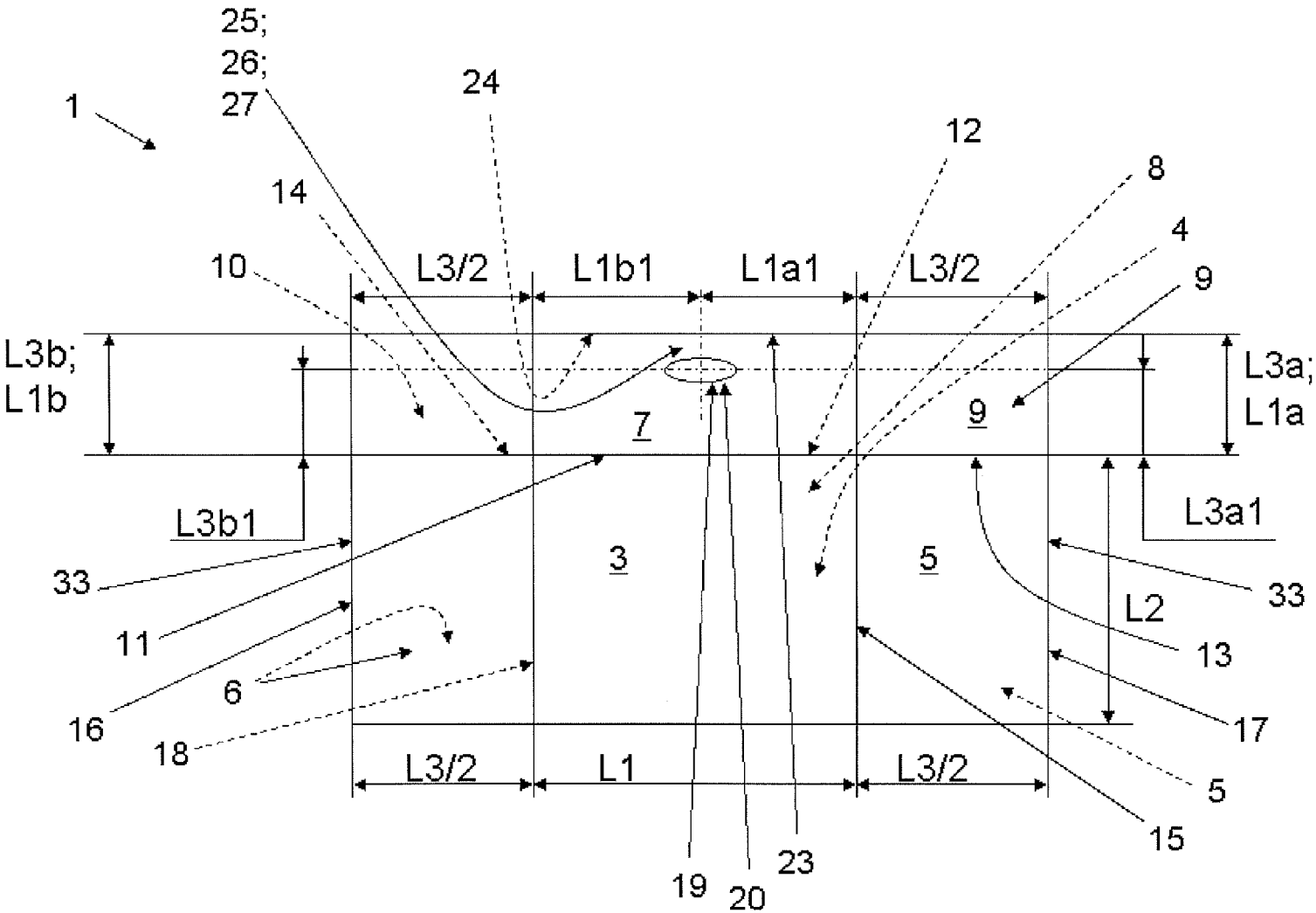
FIG. 6 schematically shows a front view of a collapsed cardboard box according to FIG. 5.
Figure 7:
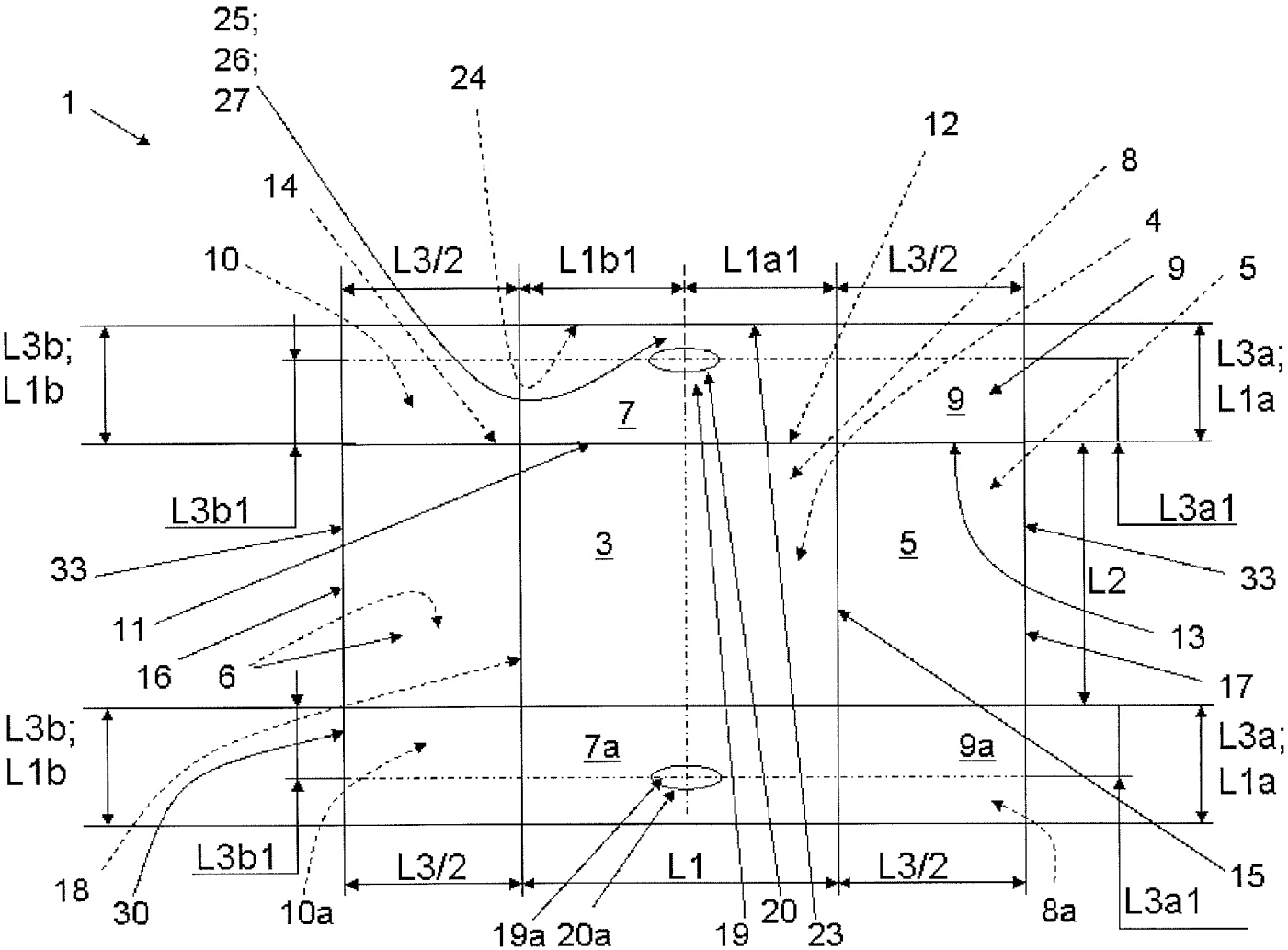
FIG. 7 schematically shows a front view of a collapsed cardboard box according to FIG. 5, but with an additional top side.

FIGS. 6 and 7 schematically shows a front view of the collapsed cardboard box according to FIG. 5. FIG. 6 shows a five sided box 1 with an opening 22 and FIG. 7 shows a six sided box with a top side 30 replacing the opening. The box and the position of the first and second through holes have been described in connection to FIGS. 1-7.

Figure 8:
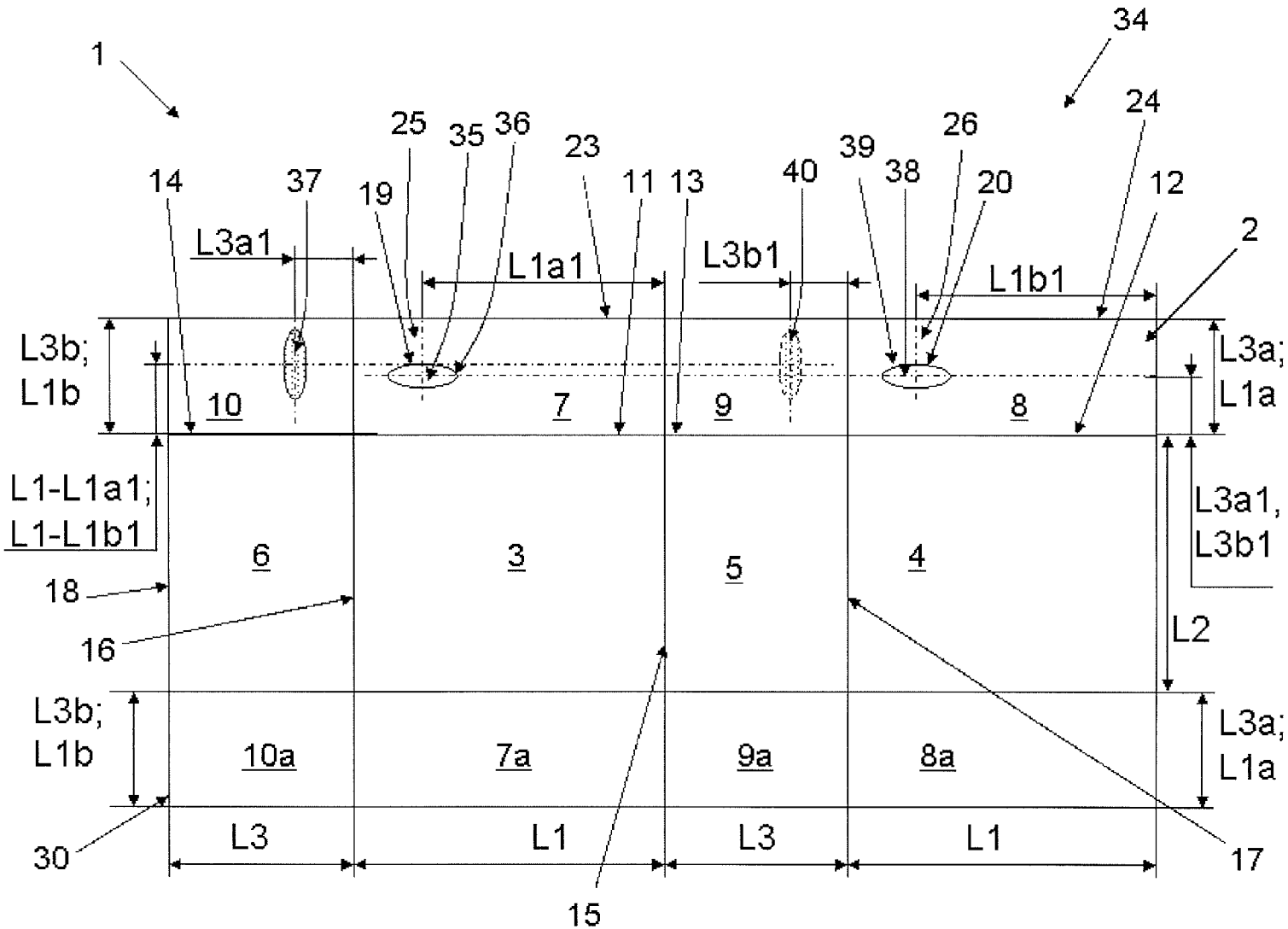
FIG. 8 schematically shows a front view of a blank comprising all elements making up a six sided box according to a fourth example of the invention.

FIG. 8 schematically shows a front view of a blank comprising all elements making up a six sided box 1 according to a fourth example of the invention. The description of the holes geometries etcetera in FIGS. 1-7 is valid also for FIG. 8.

The box 1 is formed from a blank 34 comprising the front wall 3, the back wall 4, the first and second side walls 5, 6, the front portion 7, the back portion 8 and the first and second side portions 9, 10. The blank 34 has been slit between: the front portion and the first side portion; and between the front portion 7 and the second side portion 10; and between the back portion 8 and the first side portion 9.

As been described in connection to FIG. 3, the top side comprises a top front portion 7, a top back portion 8, a top first side portion 9 and a top second side portion 10 which could be folded and equipped with a top first through hole (nor shown) in the top front portion (not shown) and a top second through hole in the top back portion 8 in accordance with what has been described in connection to FIGS. 1-2.

The blank 34 has been slit between: the top front portion and the top first side portion; and between the top front portion 7 and the top second side portion 10; and between the top back portion 8 and the top first side portion 9.

The length of each slit defines L1*a*, L1*b*, L3*a* and L3*b*. In FIG. 8, L1*a*=L1*b*=L3*a*=L3*b*, but can vary dependent on hole position, folding methods etc. which have already been discussed in connection to FIGS. 1-7. In FIG. 8 L1*a*, L1*b*, L3*a* and L3*b* refers both to the top side portions and to the bottom side portions, but it should be noted that this is just to easily describe embodiments of the invention. The parameters L1*a*, L1*b*, L3*a* and L3*b* may be different in the top side 30 than in the bottom side 2 and the method of folding the bottom side may be different from the method of folding the top side 30. In FIG. 8, only the front portion and the back portions have first and second through holes.

The blank 34 in FIG. 8 is rectangular and the second side wall 6 is not connected or attached to the back wall 4, but the front wall is attached to the first side wall 5 and the second side wall 6 and the back wall 4 is connected to the first side wall 5. Naturally, this is only an example of a blank 34 and the disconnection between the walls 3-6 in the blank 34 can be between any of the walls 3-6 dependent on, for example production strategy. When creating the box from the blank 34, the front wall 3 is attached to the first side wall 5 and the second side wall 6 and the back wall 4 is connected to the first side wall 5 and the second side wall 6. The fold lines 11-18 described in connection to FIGS. 1-7 are referred to with regard to the blank in FIG. 8.

The erected box 1 in FIGS. 1-7 has been described to have either the first and second through holes 19, 20 pre-made or that the first and second through holes 19, 20 are created when the box 1 is collapsed for the first time, i.e. when unfolding the bottom side 2, by allowing parts/areas to be separated from the front portion 7 and back portion 8 respectively thereby creating the first and second through holes 19, 20.

FIG. 8 shows the front portion 7 comprising a first area 35 with weak perimeter 36. In the erected box, the first area 35 is attached to an underlying part of the box 1 in such a way that when unfolding the front portion 7 the weak perimeter 36 breaks and the first area 35 stays attached to the underlying part wherein the first through hole 19 is created. FIG. 8 shows with a first shaded portion 37 where the first area 35 will be positioned on the second side portion 10 when the second side portion 10 is underlying the front portion 7 according to FIG. 1.

The back portion 8 comprises a second area 38 with weak perimeter 39, which second area 38 is attached to an underlying part of the box 1 in such a way that when unfolding the back portion 8 the weak perimeter breaks 39 and the second area stays attached to the underlying part wherein the second through hole 20 is created. FIG. 8 shows a second shaded portion 40 where the second area 38 will be positioned on the first side portion 9 when the first side portion 9 is underlying the back portion 8 according to FIG. 1. If L1*a*1 and L1*b*1 would have been shorter, the first shaded portion 37 could have been positioned in the first side portion 9 and the second shaded portion 39 could have been positioned in the second side portion 10.

If the first and second through holes 19, 20 are to be created when unfolding the bottom side 2, the first and second side portion 10 advantageously are folded before the front portion 7 and back portion 8 since the parts/areas that are to be separated from the front portion 7 and back portion 8 respectively has to be permanently attached to an underlying material, advantageously the first side portion 9 and the second side portion, respectively. The advantage lies in the simplicity of folding together the bottom side and the simplicity during manufacturing of the box since essentially there is only needed one rectangular blank with slits forming the front portion, the back portion the first side portion and the second side portion.

The first and second areas could be attached to the underlying material by way of any type of attachment means, for example glue, adhesive tape, welding (for example ultrasonic), calendaring and/or embossing.

Figure 9:
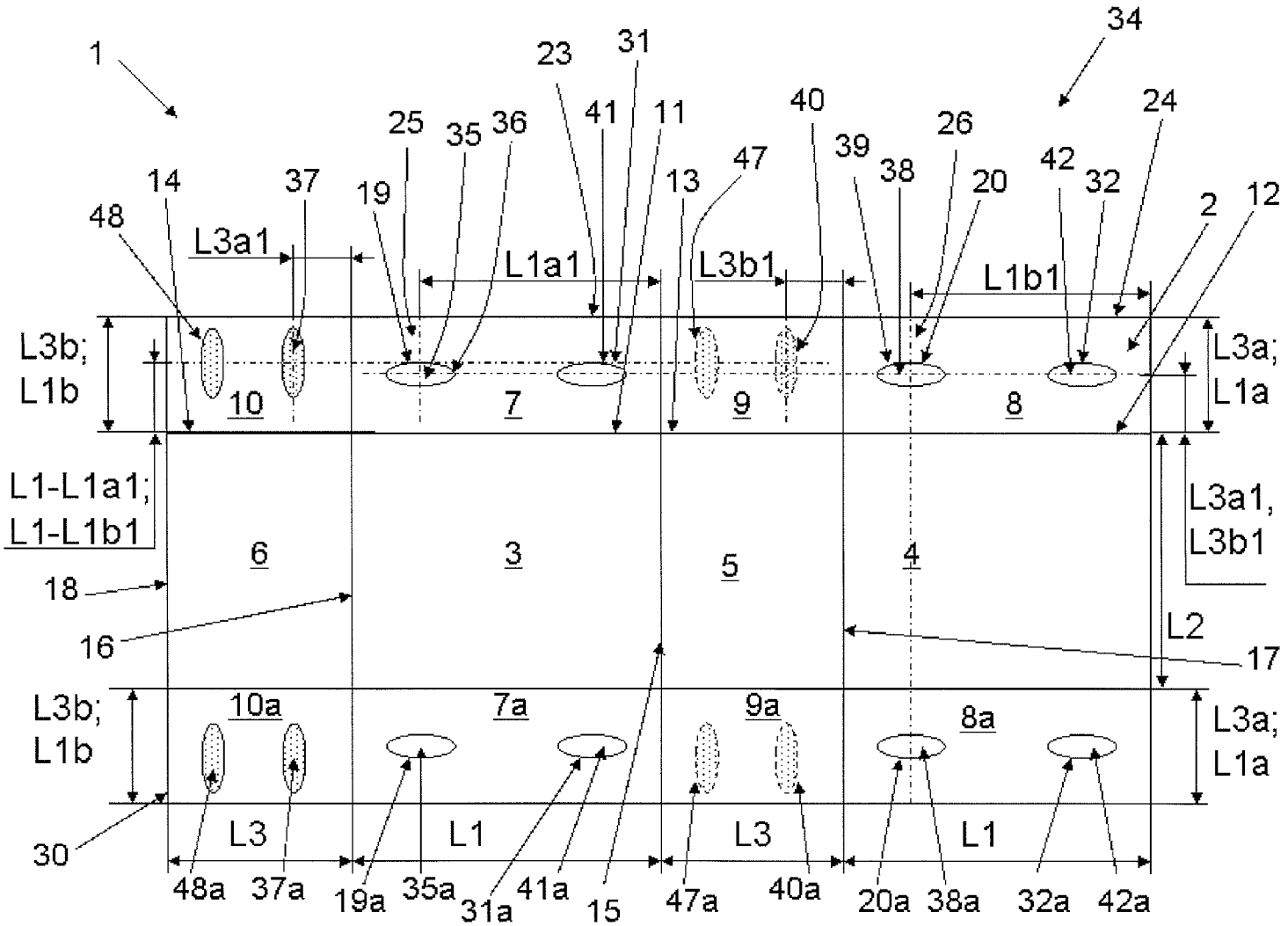
FIG. 9 schematically shows a front view of a blank comprising all elements making up a six sided box according to a fifth example of the invention.

FIG. 9 schematically shows a front view of a blank comprising all elements making up a six sided box 1 according to a fifth example of the invention. The description of the blank in FIG. 9 is identical to the description of FIG. 8, but with the addition of further through holes as been described, for example FIGS. 3 and 4.

In FIG. 9, a third through hole 31 is positioned in the front portion 7 with a corresponding third area 41 being marked with a third shaded portion 47 positioned in the first side portion 9, and a fourth through hole 32 is positioned in the back portion 8 with a corresponding fourth area 42 being marked with a fourth shaded portion 48 positioned in the second side portion 10.

In FIG. 9, a top first through hole 19*a* is positioned in the top front portion 7*a* with a corresponding top first area 35*a* being marked with a top first shaded portion 37*a* positioned in the top second side portion 10*a*, and a top second through hole 20*a* is positioned in the top back portion 8*a* with a corresponding top second area 38*a* being marked with a top second shaded portion 40*a* positioned in the top first side portion 9*a*.

In FIG. 9, a top third through hole 31*a* is positioned in the top front portion 7*a* with a corresponding top third area 41*a* marked with a top third shaded portion 47*a* positioned in the top first side portion 9*a*, and a top fourth through hole 32*a* is positioned in the top back portion 8*a* with a corresponding top fourth area 42*a* being marked with a top fourth shaded portion 48*a* positioned in the top second side portion 10*a*.

The additional through holes and areas in FIG. 10 have the same properties and positions governed by rules of symmetry as been described in connection to holes and areas described in FIG. 9.

Furthermore, the areas described in connection to FIG. 9 are delimited by a weak perimeter in order for the areas to be attached and to an underlying portion of the box and then to be removed when the box is collapsed.

According to one example of the invention (not shown), the first and/or the second areas (and where appropriate additional areas for additional through holes) are only partly delimited by a weak perimeter/line which gives the user the possibility to create the through holes by pressing onto the first and/or second areas so that the weak lines are ruptured in such a way that the first and/or second area are still attached to the box and thus form a flap that can be used in the collapsed state for inserting into one or many through holes for a better grip and/or for securing the collapsed box in the collapsed state.

The areas that are to be removed when collapsing the box could be omitted in the example shown in FIGS. 8 and 9. The through holes 19, 20, 31, 32, 19*a*, 20*a*, 31*a*, 32*a* are then pre-made as described in connection to FIGS. 1-7.

Figure 10:
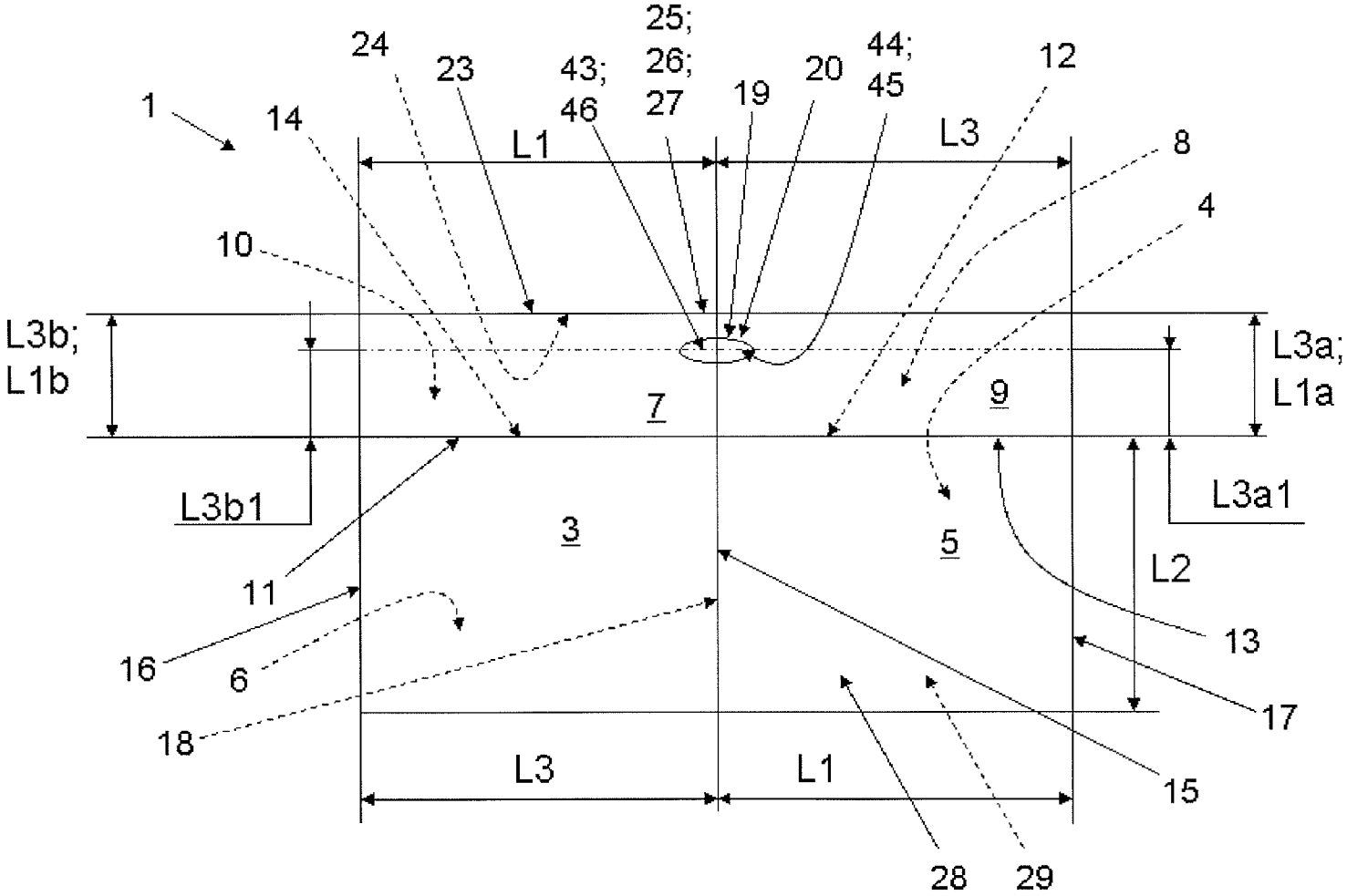
Figure 11:
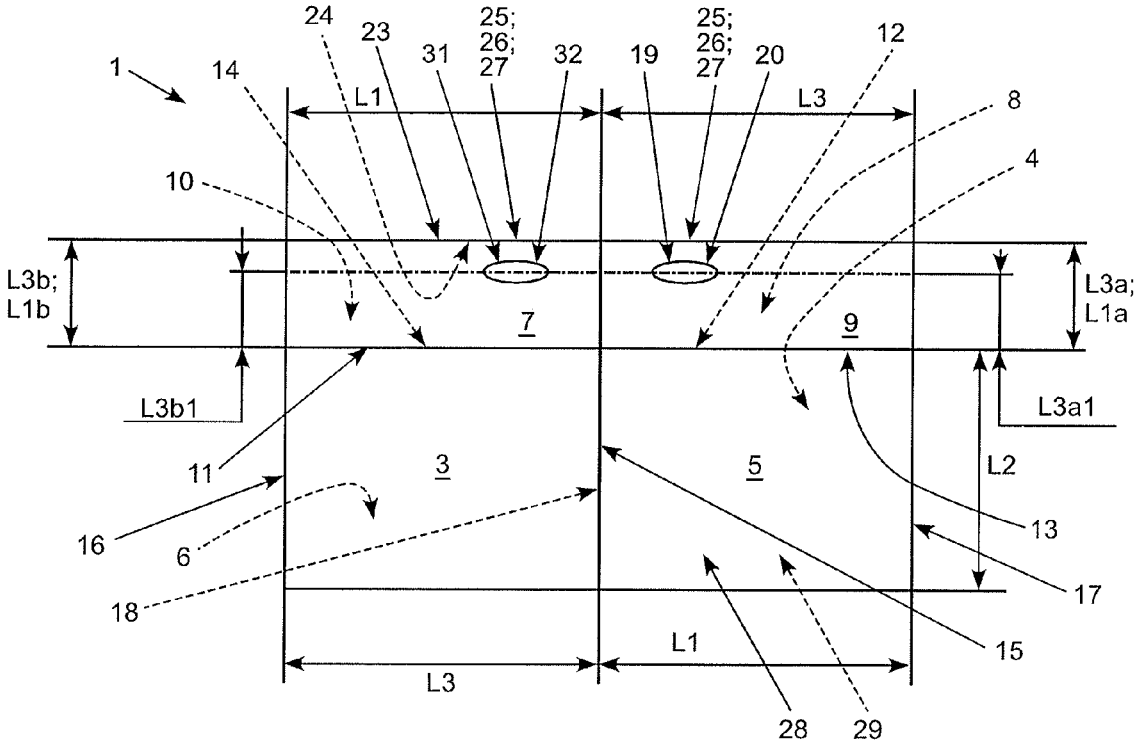
FIG. 11 schematically shows a front view of a collapsed cardboard box according to a seventh example of the invention.

FIG. 10 shows a sixth example of a box 1 according to the invention having a quadratic cross-section. In FIG. 10, L1=L3 which gives a quadratic bottom side 2. In FIG. 1 L2>L1=L3 which means that the box 1 is rectangular cuboid, but L2 could be equal to L1 and L3 giving the box a cubic shape. In order for the first and second through holes 19, 20 to be in line when the box 1 is collapsed, L1*a*1 must be equal to L3*a*1 being equal to zero when the box is collapsed over the first, second third and fourth corner fold lines 15, 16, 17, 18 positioned between the walls. The embodiment shown in FIG. 5, with a symmetrical fold lines gives different possibilities because the rules of symmetry work differently.

In FIG. 10, L1*a*1=L1*b*1=0 and the imaginary axis becomes the zero axis that delimits the first through hole 19 into a first and second hole portions 43, 44 and the second through hole 20 into a third and fourth hole portions 45, 46. When L1*a*1=0 rules of symmetry gives that L1*b*1=0 and the first and second through holes 19, 20 becomes into two halves compared to the original shape as depicted in FIG. 1. In FIG. 10, the first hole portion 43 of the first through hole 19 is positioned in the front portion 7 and second hole portion 44 of the first through hole 19 is positioned in the first side portion 9, such that when the box 1 is in the collapsed state the first and second hole portions 43, 44 in the front portion 7 and the first side portion 9 respectively form the first through hole 19. The third and fourth hole portions 45, 46 in the back portion 8 and the second side portion 10 respectively form the second through hole 20. The first and second through holes 19, 20 then are in line with each other when the box 1 is in the collapsed state forming the handle 27. Hence, when the first and second through holes 19, 20 are larger than L1*a*1 and L1*b*1, respectively, a portion of the first through hole 19 could be positioned in the front portion 7 and the remaining portion of the first through hole 20 could be positioned in the first side portion 9 and a portion of the second through hole 20 could be positioned in the back portion 8 and the remaining portion of the second through hole 20 could be positioned in the second side portion 10. Ultimately, L1*a*1=0 and consequently L1*b*1=0 and the first and second through holes 19, 20 are split in halves according to the above.

The example in FIG. 10 is valid for all examples and embodiments described in connection to FIGS. 1-9 when L1 and L3 relative each other are such that the size of the first and second through holes 19, 20 (or any other of the described through holes) have a size giving a length L1*a*1 and a length L1*b*1 being less than half the hole. This happens when L1-L3 is less than L1*a*1 and L1*b*1. The rules of symmetry give that L1*a*1=L1*b*1 and L3*a*1=L3*b*1 in order for the first and second through holes 19, 20 shall be in line when each other forming the previously described handle when the box is collapsed. The first and second hole portions 43, 44 and the third and fourth hole portions 45, 46 may either be part of the box when erected as described in connection to FIGS. 1-7 or may be created by removal of corresponding areas as described in connection to FIGS. 8 and 9.

The invention claimed is:

1. A collapsible cardboard box comprising:

a front wall;

a back wall opposing the front wall;

a first side wall;

a second side wall opposing the first side wall; and a bottom side being made from folding together over predetermined folding lines a front portion being attached to the front wall, a back portion attached to the back wall, a first side portion being attached to the first side wall and a second side portion being attached to the second side wall, wherein, in a collapsed state, the box comprises a first through hole positioned at least partially in the front portion, a second through hole positioned at least partially in the back portion, a third through hole positioned at least partially in the front portion, and a fourth through hole positioned at least partially in the back portion, and wherein, in the collapsed state, the first and second through holes are in line with each other and/or that the third through hole and the fourth through hole are in line with each other forming a handle for allowing a person to carry the collapsed box.

2. The collapsible box according to claim 1, wherein the front portion and the front wall are made from one piece comprising a predetermined first fold line dividing the front portion and the front wall, wherein the back portion and the back wall are made from one piece comprising a predetermined second fold line dividing the back portion and the back wall, wherein the first side portion and the first side wall are made from one piece comprising a predetermined third fold line dividing the first side portion and the first side wall, and wherein the second side portion and the second side wall are made from one piece comprising a fourth predetermined fold line dividing the second side portion and the second side wall.

3. The collapsible box according to claim 2, wherein the box is formed from a blank comprising the front wall, the back wall, the first and second side walls, the front portion, the back portion and the first and second side portions.

4. The collapsible box according to claim 1, wherein, in the collapsed state, at least a part of the front wall and at least a part of the second side wall face each other.

5. The collapsible box according to claim 4, wherein, in the collapsed state, the front wall and the second side wall, at least partly are in contact with each other and wherein the back wall and the first side wall, at least partly, are in contact with each other, for allowing the user to secure the collapsed box in its folded position by gripping the handle.

6. The collapsible box according to claim 1, wherein, in the collapsed state, the front wall, the front portion, the first side wall and the first side portion form a first side unit of the collapsed box, wherein the back wall, the back portion, the second side wall and the second side portion form a second side unit, and wherein the first side unit and the second side unit face each other and are, at least partly, in contact with each other to allow the user to secure the collapsed box in its folded position by grabbing the handle.

7. The collapsible box according to claim 1, wherein, in the collapsed state, the first side wall and the second side wall have been folded over symmetrical fold lines being positioned in the first side wall and the second side wall extending in a direction from the bottom side to an opening of the box, when the box is a five sided box, or to a top side in the box, when the box is a six sided box, wherein, in the collapsed state, the front wall faces only the back wall and the front portion faces only the back portion, and wherein the first side wall, the first side portion, the second side wall and the second side portion are double folded.

8. The collapsible box according to claim 1, wherein the front portion comprises the first through hole and wherein the back portion comprises the second through hole.

9. The collapsible box according to claim 1, wherein, the front portion comprises a first area with a weak perimeter, which first area is attached to an underlying part of the box in such a way that when unfolding the front portion the weak perimeter breaks and the first area stays attached to the underlying part creating the first through hole, and wherein the back portion comprises a second area with a weak perimeter, which second area is attached to an underlying part of the box in such a way that when unfolding the back portion the weak perimeter breaks and the second area stays attached to the underlying part creating the second through hole.

10. The collapsible box according to claim 1, wherein the front portion comprises a first area and the back portion comprises a second area, wherein the first and/or the second areas are only partly delimited by a weak perimeter/line for allowing the user to create the first and second through holes by pressing onto the first and/or second areas so that the weak lines are ruptured in such a way that the first and/or second areas are still attached to the box and thus form a flap that can be used in the collapsed state for inserting into the through holes for a better grip and/or for securing the collapsed box in the collapsed state.

11. The collapsible box according to claim 1, wherein, in the collapsed state, the first through hole and the second through hole are positioned for allowing a person to balance the collapsed box approximately about the center of gravity of the collapsed box.

12. The collapsible box according to claim 1, wherein, the front wall, the first side wall, the back wall and the second side wall are attached to each other.

13. The collapsible box according to claim 1, wherein the first through hole comprises first and second hole portions and the second through hole comprises third and fourth hole portions, wherein the first hole portion of the first through hole is positioned in the front portion and the second hole portion of the first through hole is positioned in the first side portion such that when the box is in the collapsed state the first and second hole portions in the front portion and the first side portion, respectively, form the first through hole, and wherein the third and fourth hole portions in the back portion and the second side portion, respectively, form the second through hole.

14. The collapsible box according to claim 1, wherein the box comprises a top side opposite the bottom side comprising a top front portion, a top back portion, a top first side portion, and a top second side portion, wherein the top front portion comprises a top first through hole and the top back portion comprises a top second through hole, and wherein, in the collapsed state, the top first through hole is in line with the top second through hole for forming a handle.

15. The collapsible box according to claim 14, wherein the top first through hole is positioned in the top front portion with a corresponding removable top first area for creating the top first through hole upon removal and wherein the top second through hole is positioned in the top back portion with a corresponding removable top second area for creating the top second through hole upon removal.

16. The collapsible box according to claim 14, wherein the top front portion comprises a top third through hole and wherein the top back portion comprises a top fourth through hole, the top third through hole and the top fourth through hole in line with each other when the box is in the collapsed state.

17. The collapsible box according to claim 16, wherein the top third through hole is positioned in the top front portion with a corresponding removable top third area for creating the top third through hole upon removal and wherein the top fourth through hole is positioned in the top back portion with a corresponding removable top fourth area for creating the top fourth through hole upon removal.

18. The collapsible box according to claim 1, wherein the first and second through holes are elongated to fit a hand of a human user.

19. The collapsible box according to claim 13, wherein, in the collapsed state, the front wall and the second side wall are in contact with only each other and wherein the back wall and the first side wall are in contact with only each other.

20. A collapsible box comprising:

a front wall;

a back wall opposing the front wall;

a first side wall;

a second side wall opposing the first side wall; and a bottom side being made from folding together over predetermined folding lines a front portion being attached to the front wall, a back portion attached to the back wall, a first side portion being attached to the first side wall and a second side portion being attached to the second side wall, wherein, the box comprises a first through hole positioned in the front portion, a second through hole positioned in the second side portion, a third through hole positioned in the first side portion, and a fourth through hole positioned in the back portion, wherein, in a collapsed state, the front wall and the second side wall are in contact with only each other and wherein the back wall and the first side wall are in contact with only each other, and wherein, in the collapsed state, the first and second through holes are in line with each other and/or the third through hole and the fourth through hole are in line with each other forming a handle for allowing the user to secure the collapsed box in its folded position by gripping the handle.

* * * * *